United States Patent [19]

Molnar

[11] 4,084,790

[45] Apr. 18, 1978

[54] MULTI-PURPOSE VEHICLE SERVICE HOIST

[76] Inventor: Frank Molnar, 47 Gladys St., Clarence Gardens, South Australia, Australia

[21] Appl. No.: 770,383

[22] Filed: Feb. 22, 1977

[30] Foreign Application Priority Data

Apr. 2, 1976 Australia ..... PC 5471

[51] Int. Cl.[2] ..... B66F 7/10

[52] U.S. Cl. ..... 254/90; 187/8.47

[58] Field of Search ..... 254/89–92, 254/133, 134; 187/8.47, 8.54, 8.5, 8.67

[56] References Cited

U.S. PATENT DOCUMENTS

| | | | |
|---|---|---|---|
| 3,724,602 | 4/1973 | Hernick | 187/8.54 |
| 3,779,517 | 12/1973 | Fisher | 254/134 |
| 3,818,579 | 6/1974 | Pietrelli | 254/89 H |
| 3,958,664 | 5/1976 | Perkins | 254/89 R |

*Primary Examiner*—Robert C. Watson

*Attorney, Agent, or Firm*—Wofford, Felsman, Fails & Zobal

[57] ABSTRACT

A two post vehicle hoist suitable for use in the servicing of a vehicle, having a pair of adjustable lift arms on each post for lifting the vehicle, the hoist being characterized by transversely extending guides positioned one fore and the other aft of the guide posts, and longitudinally extending tracks supported by the guides into which a vehicle can be driven before being lifted for servicing.

8 Claims, 7 Drawing Figures

MULTI-PURPOSE VEHICLE SERVICE HOIST

Figure 1:
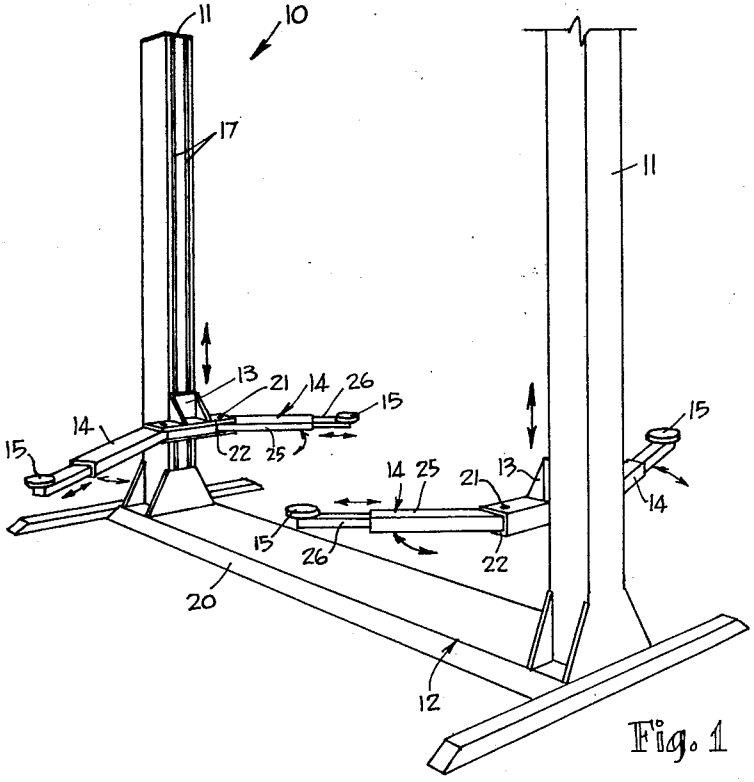

This invention relates to a vehicle service hoist of the type which comprises a pair of vertical spaced columns attached to a shallow base member, a lifting carriage on each column guided for vertical movement with respect thereto, a pair of retractable and adjustable lifting arms attached to each carriage, vehicle support means on each arm, lifting means connected to both carriages, and safety means operable to prevent downward movement of the carriages should failure of the lifting means occur. My Australian Pat. No. 470,742 describes such a hoist.

Hoists constructed according to this invention have proved to be of considerable commercial value, and the main object of this invention is to provide further improvements which will make the hoist a multi-purpose hoist.

For some purposes it is desirable that a hoist should support a vehicle so that its wheels are suspended to be free to rotate, the vehicle being supported by pads on arms, and hoists of the above defined type achieve this. However for other purposes it is desirable that the vehicle should remain supported by its wheels, this being particularly the case when it is required to align the front and rear wheels of the vehicle. Furthermore, the positioning of pads beneath the vehicle chassis takes some time which can be avoided if it is not necessary for the wheels to be free running, and in order to achieve a hoist which can either support a vehicle for its wheels to be freely rotating or alternatively support the vehicle in an elevated position but on its wheels, there is provided a pair of transverse guides, longitudinally extending tracks carried on the guides which can be so spaced as to support a vehicle when driven on the tracks, and releasable engagement means between the guides and the hoist arms. If the engagement means are engaged, operation of the hoist will cause elevation of the tracks so that a vehicle can be lifted after having been "driven onto" the tracks. If however the release means are released, the tracks can remain on the ground and a vehicle can be lifted by engagement of its chassis with pads on the arms, as in other vehicle service hoists of the same general type.

Specifically, in this invention a service hoist comprises a pair of transversely extending guides positioned one fore and the other aft of the columns, releasable engagement means joining the ends of the guides to corresponding ends of the arms and constructed and arranged so that elevating the arms will effect corresponding elevation of the guides, and a pair of longitudinally extending tracks transversely spaced from each other supported by the guides.

If a vehicle is to have its wheel aligned, it is most desirable that the vehicle should be supported on an horizontal plane, and in another aspect of this invention there is included levelling legs which are positionable beneath the tracks and between the tracks and the ground or footing means on the ground. The levelling legs can be so adjusted upon installation of the hoist that the tracks are horizontal and in the same plane when the legs are supported by the ground or footing means beneath them, and this can be achieved without the need to have a perfectly level floor.

Different vehicles of course have different track widths, and in order to accommodate the different track widths in a further aspect of the invention there are included rollers on one of the tracks engaging the transverse guides so that the track is laterally movable with respect to the other said track.

In the alignment of wheels, it is sometimes desirable that the wheels can be turned as in steering, and in a still further aspect of the invention, the tracks include turntables at one end, the turntables being in transverse alignment with one another and each being rotatable about a vertical axis.

Figure 2:
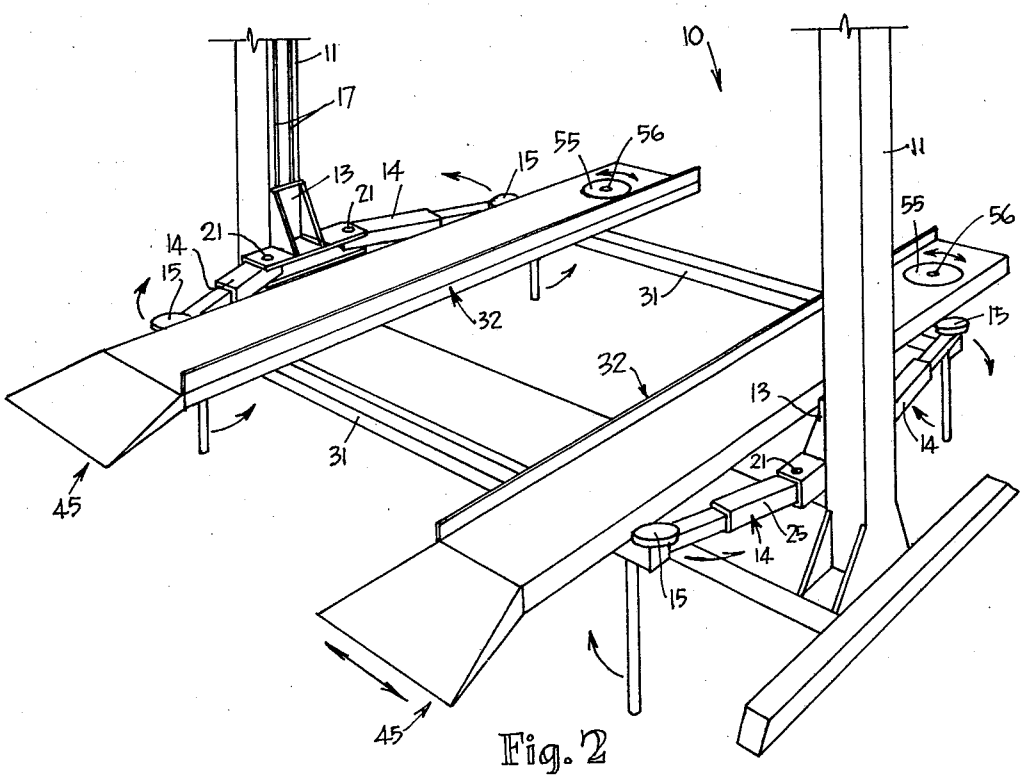
Figure 5:
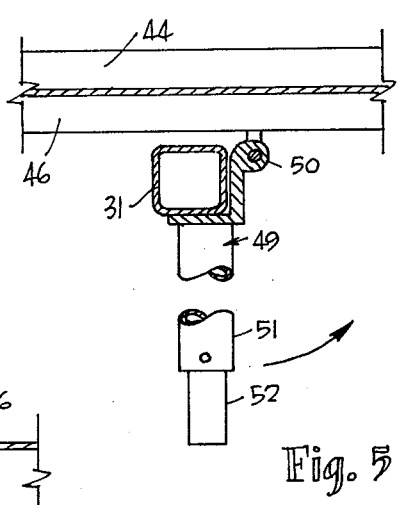
Figure 3:
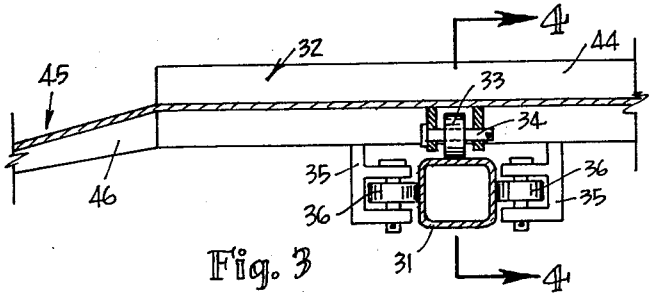
Figure 4:
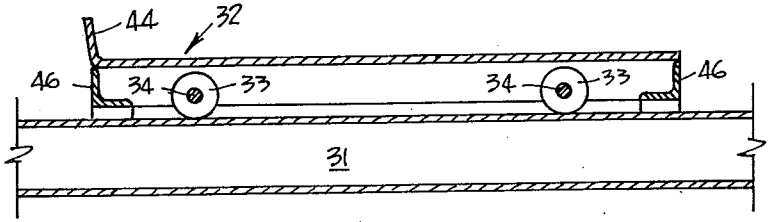
Figure 6:
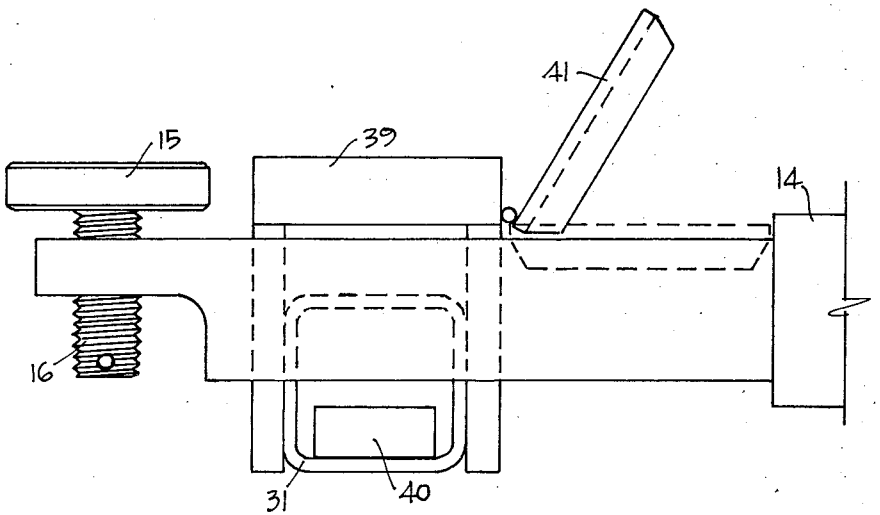
Figure 7:
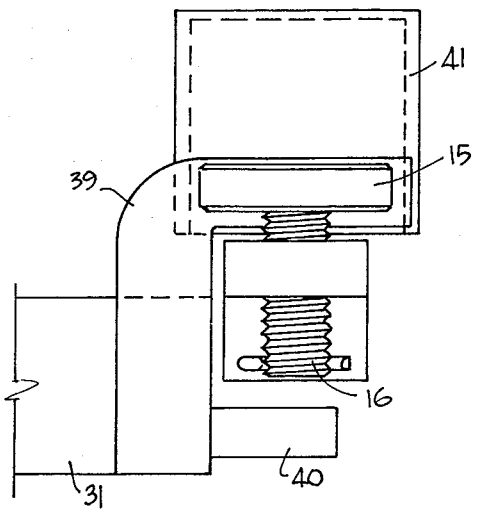

An embodiment of the invention is described hereunder in some detail with reference to and as illustrated in the accompanying drawings, in which FIG. 1 is a perspective view illustrating a vehicle service hoist of the type which embodies this invention, FIG. 2 is a corresponding perspective view of a hoist in which the invention is embodied, the arrows on FIG. 2 illustrating various possible movements, FIG. 3 is a fragmentary cross-section through a guide, drawn to a larger scale, illustrating an arrangement of rollers, FIG. 4 is a section on line 4—4 of FIG. 3, FIG. 5 is a section similar to FIG. 3 but illustrating an arrangement of hinged telescopic legs, FIG. 6 is a fragmentary elevation of engagement means joining the ends of the guides to the ends of the arms, and FIG. 7 is an end elevation of FIG. 6.

In this embodiment a vehicle hoist 10 comprises a pair of vertical columns 11 attached to a common shallow base member 12, and a pair of lifting carriages 13, each carriage being guided for vertical movement on a respective column. There is also provided a pair of telescopically retractable and adjustable lifting arms 14 attached to each carriage 13 supporting pads 15 on the free ends of the arms 14 (the supporting pads 15 being on screw threaded members 16 to provide vertical adjustment as shown in FIGS. 6 and 7), hydraulically operated lifting means (not shown) and connected to both carriages and safety means for the preventing of downward movement of either carriage in the event of failure.

The columns 11 are each of rectangular cross-section steel with rigid feet of extended size (not shown) for attachment to the shallow base member 12. The opposing faces of the columns 11 are parallel and the column has housed internally, carriage support members (not shown) of rectangular cross section having guide rollers attached thereto at all corners, the rollers being arranged to rotate on axes perpendicular to each other, the rollers engaging the inner faces of the columns to permit free movement of the carriage support member up and down the columns. Each carriage is attached to its respective support member by arms extending through a vertical parallel wall slot 17 in the side wall of the column. The base member comprises an elongate rectangular frame of channel section steel with sloping sides 20 of length sufficient to accommodate the width of a vehicle between the lifting carriages, and with end members exceeding the width of the frame by an amount which ensures that the supporting pads when positioned under the largest vehicle to be lifted do not extend substantially beyond the ends of the end members. The end members are provided with floor attachment means at their extreme ends thereof. The inwardly opposing faces of each of the carriages each carries a pair of pivot pins 21 with vertical axes which provide a hinged attachment of lifting arms having freedom of swivel movement in an horizontal plane, the pivots being supported between horizontal plates 22.

Each lifting arm comprises a rectangular outer tubular portion 25 engageable between the plates 22 and having a circular aperture engaged by one of the pivot pins 21 and its outer hollow rectangular section horizontal arm is engaged telescopically by an inner elongate arm member 26 having an horizontal supporting pad 15 at its outer end. The lengths of the telescopic members are such that when a vehicle is driven between the columns the supporting pads can be positioned beneath the vehicle by a simple swivelling and sliding movement.

The hydraulically operative lifting means is not shown, but comprises a hydraulic ram having a cylinder mounted inside one of the columns, the free end of the ram extending vertically upwards and having a pulley pivotally attached thereto for rotary motion about an axis transverse of the axis of the ram. A cable, attached at one end of the adjacent carriage support member, passes over the pulley, downward through the column, around a pulley mounted at the bottom of the column, across beneath the base member, around a second pulley mounted at the bottom of the second column, vertically upwards inside said second column, around a third pulley mounted at the second column and downwardly to the second carriage support member to which it is attached.

In operation the first carriage moves twice the distance moved by the pulley on the end of the ram and both carriages move upwardly and downwardly by the same amount.

An electrically driven pump supplies hydraulic fluid at constant pressure to a manually operated valve, the pump suction line being connected to a fluid reservoir and the delivery to a pressure raising valve, from which it is then returned to the reservoir.

To ensure safety of the operator in the event of failure (either of the pressure supply or the cables) spring loaded ratchets on each of the support members engage a series of upwardly facing tooth projections on a vertical elongate member attached to the top and bottom of each column and located in the slots between the carriage attachment arms, the ratchets being held out of engagement by the tension of the cables compressing the springs and the projections being associated with upwardly sloping top faces so that the ratchets cannot be disengaged without the carriages being raised.

Each ratchet is of bell-crank shape and has a central pivot, the upper end of the ratchet being engageable with an abutment member attached to the cable and having a helical spring between the opposite side of the abutment member and the carriage support member, release of compression due to the breaking of cables or the like forcing the ratchet into engagement with the upwardly facing projections while normal lowering is not restricted while there is a load on the cables.

As far as the embodiment has been thus described, it forms portion of prior art, being substantially identical to the embodiment described with respect to said Australian Pat. No. 470,742 and, as said, is a commercially valuable two-post hoist. However the improvements in this embodiment comprise an assembly which consists of two parallel spaced transverse guides 31, one on each side of the shallow base member 12. The guides 31 support two transversely spaced longitudinally extending tracks 32, one of the tracks being secured thereto by securing means extending through a bracket on the guides, the other track 32 however being provided on its under surface with rollers 33 journalled on pins 34 carried on a frame member, the track also having depending blocks 35 (FIG. 3) to which are journalled side rollers 36 which engage the side surfaces of the guide 31, so that the second track is quickly and easily moved transversely over the guides from one location to another to thereby enable it to be aligned with the wheels of a vehicle.

Each end of each guide 31 has secured thereto (by means of welding) an inverted L-shaped bracket 39 (FIG. 7) outstanding therefrom, and each bracket is so positioned that the telescopic end of the respective lifting arm 14 can be located beneath its horizontal flange when the lifting arm is in its lowermost position and the tracks are supported by the ground. In order to prevent accidental downward displacement of the lifting arm 14 relative to the bracket 39, a bar 40 extends beneath the lifting arm 14 when the lifting arm 14 is in position and a retaining channel section member 41 is pivoted to the bracket 39 (see FIG. 6) and normally drops into position over the lifting arm 14 restraining it against horizontal sideways displacement. The channel section member 41 drops over the telescopic portion of the lifting arm to abut the end of the larger lifting arm portion thereby fixedly locating the transverse guide with respect to the lifting carriages, as best illustrated in FIG. 6. With the lifting arms 14 coupled to the guides 31, that is with the telescopic end of each arm 14 engaging under an L-shaped bracket 39 and the members 41 engaging against the sides of the arms, lifting of the arms effects simultaneous lifting of the guides 31 and their associated tracks 32.

Each track 32 is a plate like member having upwardly sloping side wings 44 or flanges, and has ramp ends 45 which are of larger dimension transversely than the intermediate portion of the track. The track is supported between the guides by means of depending angle-section members 46 (FIG. 4) which provide the necessary strength and stiffness. As said above, it is desirable that the tracks should be horizontal and in the same plane when aligning wheels or steering or effecting certain adjustments, and in order to achieve this, as shown in FIG. 5 there are provided four legs 49 each hinged to the support angles 46 beneath respective guides 31, each leg 49 depending from an Lshaped portion of a hinge 50, and each leg 49 comprising an upper tube portion 51 of larger diameter and a lower tube portion 52 of relatively smaller diameter slidable therein. However upon adjustment of the correct height, the two tube members are pinned together so that the adjustment needs to be made only once. The legs are of the required height (about 1 metre) to facilitate alignment, but are normally held retracted by hinging upwardly and being engaged between two arms of respective spring clips (not shown).

In order to facilitate steering alignment, each track is provided with a turntable 55 near one end which is normally engaged by the front wheels of the vehicle, each turntable portion being rotatable about a vertical axis, and having a depending pin 56 which engages bearings (not shown) carried by the track 32.

It should be noted that when the tracks are raised and the vehicle is carried upwardly by the two post hoist, the floor area adjacent the hoist is clear and for example other vehicles may be manouvered beneath the elevator vehicle, this being valuable in workshops of restricted size.

I claim:

1. In a vehicle service hoist of the type having a pair of vertical transversely spaced columns attached to a shallow base member, a lifting carriage on each column guided for vertical movement with respect thereto, a pair of retractable and adjustable lifting arms attached to each carriage, vehicle support means on each arm, lifting means connected to both carriages, and safety means operable to prevent downward movement of the carriages should failure of the lifting means occur, the improvement comprising:

a pair of transversely extending guides positioned one fore and the other aft of the columns, releasable engagement means joining the ends of the guides to corresponding ends of the arms and constructed and arranged so that elevating the arms will effect corresponding elevation of the guides, and a pair of longitudinally extending tracks transversely spaced from each other supported by the guides.

2. An improved vehicle service hoist according to claim 1 further comprising hinge means beneath the tracks, and levelling legs coupled to respective said hinge means to each be movable thereby from a retracted position to an operative position wherein they support the tracks in a single horizontal plane.

3. An improved vehicle service hoist according to claim 2 wherein each said levelling leg is telescopically adjustable for length.

4. An improved vehicle service hoist according to claim 1 further comprising rollers on one of said tracks engaging the guides so as to be guided thereby towards or away from the other said track.

5. An improved vehicle service hoist according to claim 4 wherein said rollers comprise upper rollers which engage the upper surfaces of the guides and side rollers which engage the side surfaces of the guides.

6. An improved vehicle service hoist according to claim 1 further comprising a pair of vehicle wheel support turntables rotatable in respective corresponding ends of the tracks, the turntables being in transverse alignment with one another and each being rotatable about a respective vertical axis.

7. An improved vehicle service hoist according to claim 1 wherein each said releasable engagement means comprises a bracket outstanding from an end of a guide, the lower surface of which is engageable against the upper surface of a corresponding arm near an end thereof, a bar spaced from the bracket and also outstanding from the guide end and having its upper surface engageable (in the event of malfunction) against the lower surface of said arm, and locking means engageable against the side surfaces of said arm.

8. An improved vehicle service hoist according to claim 7 wherein said locking means comprises a channel section member, and hinge means joining the channel section member to said bracket, the length of the channel section member being such that in its locked position it abuts abutment means on said arm.

* * * * *